US010056715B2

(12) United States Patent
Cai

(10) Patent No.: US 10,056,715 B2
(45) Date of Patent: Aug. 21, 2018

(54) CARD EDGE CONNECTOR

(71) Applicant: LOTES CO., LTD., Keelung (TW)

(72) Inventor: You Hua Cai, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/622,486

(22) Filed: Jun. 14, 2017

(65) Prior Publication Data

US 2018/0019541 A1 Jan. 18, 2018

Related U.S. Application Data

(60) Provisional application No. 62/361,720, filed on Jul. 13, 2016.

(30) Foreign Application Priority Data

Feb. 28, 2017 (CN) ..... 2017 2 0181564 U

(51) Int. Cl.
*H01R 13/62* (2006.01)
*H01R 13/629* (2006.01)
*H01R 12/72* (2011.01)

(52) U.S. Cl.
CPC ..... *H01R 13/62938* (2013.01); *H01R 12/721* (2013.01)

(58) Field of Classification Search
CPC ..... H01R 13/62938; H01R 13/637; H01R 13/633; H01R 23/7005; G06K 13/08
USPC ..... 439/157–160, 377
See application file for complete search history.

(56) References Cited

U.S. PATENT DOCUMENTS 5,577,922 A * 11/1996 Enomoto ..... H01R 13/635 439/157
5,647,755 A * 7/1997 Hida ..... H01R 12/7005 439/157
6,932,633 B2 * 8/2005 Tsai ..... H05K 7/1405 439/160
7,517,239 B1 * 4/2009 Ju ..... H01R 13/6275 439/159

(Continued)

FOREIGN PATENT DOCUMENTS

CN 1771631 A 5/2006
CN 202025875 U 11/2011

(Continued)

*Primary Examiner* — Thanh Tam Le
(74) *Attorney, Agent, or Firm* — Locke Lord LLP; Tim Tingkang Xia, Esq.

(57) ABSTRACT

A card edge connector includes an insulating body, multiple terminals arranged at the insulating body, plastic ear clips, and metal reinforcing members embedded in the plastic ear clips. The insulating body has a slot extending along a lengthwise direction for inserting an electronic card. Each terminal has a contact portion protruding into the slot to connect the electronic card. Each plastic ear clips has a main body and a withdrawing portion disposed below the main body. The plastic ear clip has two rotating shafts at two opposite sides of the main body. The rotating shafts are pivoted to the insulating body. The withdrawing portion is used for pushing the bottom end of the electronic card to be separated from the slot. The metal reinforcing members extend in the main body and the withdrawing portions, and has a first through hole arranged at a position corresponding to the rotating shafts.

16 Claims, 7 Drawing Sheets

(56) References Cited

U.S. PATENT DOCUMENTS

| | | | | |
|---|---|---|---|---|
| 7,866,995 | B1 * | 1/2011 | Kudo | H01R 12/721 439/157 |
| 8,517,746 | B2 * | 8/2013 | Manickam | H01R 13/633 439/160 |
| 8,665,587 | B2 * | 3/2014 | Peng | G06F 1/185 361/679.31 |
| 8,753,138 | B2 * | 6/2014 | Foster, Sr. | H01R 12/7029 439/160 |
| 9,325,090 | B2 * | 4/2016 | Shen | H01R 12/7005 |
| 9,806,461 | B2 * | 10/2017 | Xu | H01R 12/737 |
| 9,876,314 | B1 * | 1/2018 | Cai | H01R 13/62938 |

FOREIGN PATENT DOCUMENTS

| | | | |
|---|---|---|---|
| CN | 202076596 | U | 12/2011 |
| CN | 202121130 | U | 1/2012 |

* cited by examiner

CARD EDGE CONNECTOR

CROSS-REFERENCE TO RELATED APPLICATION

This application claims priority and the benefit of U.S. Provisional Application No. 62/361,720, filed on Jul. 13, 2016, the entire contents of which are hereby incorporated by reference.

FIELD OF THE INVENTION

The present invention relates generally to a card edge connector, and more particularly to a card edge connector that can improve the bearing capacity of plastic ear clips and can prevent rotating shafts from breaking under forces.

BACKGROUND OF THE INVENTION

Known card edge connectors are used for connecting electronic cards. The card edge connector includes a slender insulating body, multiple terminals and a pair of ear clips. The insulating body has a slot which is used for inserting the electronic card, and the multiple terminals are arranged at two sides of the slot. The insulating body is provided with a mounting portion at each of two ends of the slot, and the ear clips are installed in the mounting portions. Each ear clip has a main body, a withdrawing portion disposed at the lower end of the main body, and a buckle portion and an operating portion disposed at the upper end of the main body. The withdrawing portion and the buckle portion respectively protrude toward the slot direction, two sides of the main body are provided with two rotating shafts, and the mounting portions are correspondingly provided with rotating shaft holes cooperated with the rotating shafts.

When the card edge connector is in a release state, the withdrawing portion may obliquely protrude into the slot, so that when the electronic card is inserted into the slot, the bottom end (i.e. a mating end) of the electronic card may push the withdrawing portion to make the ear clips gradually become relatively vertical from inclination until the buckle portion is received in a notch at a side edge of the electronic card. At the moment, the card edge connector enters a locked state from the release state. The operating portion is pressed to trigger the ear clips, so that the buckle portion is separated from the notch on the electronic card, the ear clip rotates outward to a release position from the locked position further by means of the rotation of the rotating shafts, where the withdrawing portion may push the bottom end of the electronic card to be separated from the slot.

However, with the miniaturization trend of electronic products, the card edge connector also needs to be reduced correspondingly. For the withdrawing portion, the miniaturization design requires the thickness thereof to be thinned, and since the ear clip is generally a plastic member, the bearing capacity of the ear clip is sharply decreased. In actual use, the withdrawing portion may break due to the insufficient bearing capacity, thus further influencing the quality stability and the service life of the whole card edge connector.

In order to solve the aforementioned problems, the existing card edge connector employs a plate-shaped metal sheet embedded in the ear clip. The metal sheet extends in the main body and the withdrawing portion, so that the bearing capacity of the ear clip can be improved. As the rotating shafts are force supporting points when the withdrawing portion pushes the electronic card, the force at this position is relatively large. However, when the metal sheet is embedded in the ear clip, as the metal sheet is not provided with a through hole at the position corresponding to the rotating shafts, plastics at two sides of the metal sheet are divided into two halves at the positions of the rotating shafts, thus, the plastic connection strength between the rotating shafts at two sides of the main body is insufficient, and in the card withdrawing process, the rotating shafts are easy to break from the main body when being subjected to a force.

Therefore, a heretofore unaddressed need exists in the art to address the aforementioned deficiencies and inadequacies.

SUMMARY OF THE INVENTION

In one aspect, the present invention relates to a card edge connector that ensures the miniaturization of products, and also ensures the plastic ear clips having high bearing capacity and being uneasy to break, and can prevent the breakage of the rotating shafts under force.

In certain embodiments, a card edge connector includes an insulating body, multiple terminals, a plastic ear clip, and a metal reinforcing member. The insulating body has a slot extending along a lengthwise direction and used for an electronic card to be inserted therein. The multiple terminals are arranged at the insulating body. Each terminal has a contact portion protruding into the slot to be electrically connected with the electronic card. The plastic ear clip has a main body and a withdrawing portion disposed at the lower end of the main body. The plastic ear clip has two rotating shafts arranged at two opposite sides of the main body. The rotating shafts are pivoted to the insulating body. The plastic ear clip rotates to be switched between a closing state and an opening state, and the withdrawing portion is used for pushing the bottom end of the electronic card to be separated from the slot. The metal reinforcing member is embedded in the plastic ear clip. The metal reinforcing member extends in the main body and the withdrawing portion. The metal reinforcing portion has a first through hole, and the first through hole is arranged at a position corresponding to the rotating shafts.

In certain embodiments, the size of the first through hole is smaller than the size of the rotating shaft.

In certain embodiments, the first through hole is circular and is arranged coaxially with the rotating shaft.

In certain embodiments, the metal reinforcing member further includes at least one second through hole disposed above and below the rotating shafts.

In certain embodiments, the metal reinforcing member has a base portion and a first protruding portion extending from the base portion, where the base portion extends in the main body, and the first protruding portion extends in the withdrawing portion.

In certain embodiments, the first protruding portion is provided with at least one second through hole.

In certain embodiments, the multiple terminals are arranged at two sides of the slot, the multiple terminals include a pair of opposed first terminals disposed at one end of the slot, and when the plastic ear clip is in an opening state, the first protruding portion crosses the contact portion of the first terminal in the lengthwise direction.

In certain embodiments, the first terminals are power supply terminals.

In certain embodiments, the slot has a bottom surface, the first protruding portion has an upper surface, and when the plastic ear clip is in a closing state, the upper surface is arranged to be higher than the bottom surface.

In certain embodiments, the insulating body has a projecting portion protruding upward from the bottom surface and used for upward supporting the bottom end of the electronic card, and when the plastic ear clip is in a closing state, the upper surface is arranged to be lower than the top surface of the projecting portion.

In certain embodiments, in the process of the plastic ear clip changing from the closing state to the opening state, the withdrawing portion urges the electronic card to form an urging point, and the urging point is always disposed within a length range of the first protruding portion in the lengthwise direction.

In certain embodiments, the plastic ear clip has a buckle portion extending from the main portion to the slot direction, the buckle portion is used for locking the electronic card in the closing state, and the metal reinforcing member has a second protruding portion extending into the buckle portion.

In certain embodiments, the second protruding portion is provided with at least one second through hole.

In certain embodiments, the main body has an inner side surface and an outer side surface which are arranged correspondingly in the lengthwise direction, the main body has multiple ejector pin holes which are formed in a recessing manner from the inner side surface and the outer side surface along the lengthwise direction, and the ejector pin holes are connected with the metal reinforcing member.

In certain embodiments, the metal reinforcing member is in a flat shape, and a distance from a plate edge of the metal reinforcing member to a corresponding outer surface of the plastic ear clip is greater than or equal to 0.3 mm.

In certain embodiments, the card edge connector further includes a pressing member, one end of the insulating body has a mounting portion, the plastic ear clip and the pressing member are installed at the mounting portion, the pressing member is disposed above a rotating member, the plastic ear clip has at least one crimping slope, and the pressing member slides on the crimping slope, so that the plastic ear clip rotates relative to the insulating body.

Compared with the related art, the metal reinforcing member of the present invention is embedded in the plastic ear clip, and the metal reinforcing member extends in the main body and the withdrawing portion, so that the existence of the metal reinforcing member improves the connection strength between the main body and the withdrawing portion, i.e. the bearing capacity of the plastic ear clip is improved, and the withdrawing portion is uneasy to break when the withdrawing portion pushes the electronic card to be withdrawn from the slot. Moreover, the metal reinforcing member has the first through hole, the first through hole is arranged at the position corresponding to the rotating shafts, and when the plastic ear clip is injection molded, plastics formed in the first through hole are integrally connected with the plastics at two sides of the metal reinforcing member, so the connection strength between the rotating shafts at two sides of the plastic ear clip can be improved, and the rotating shaft can be prevented from breaking from the main body under a force.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
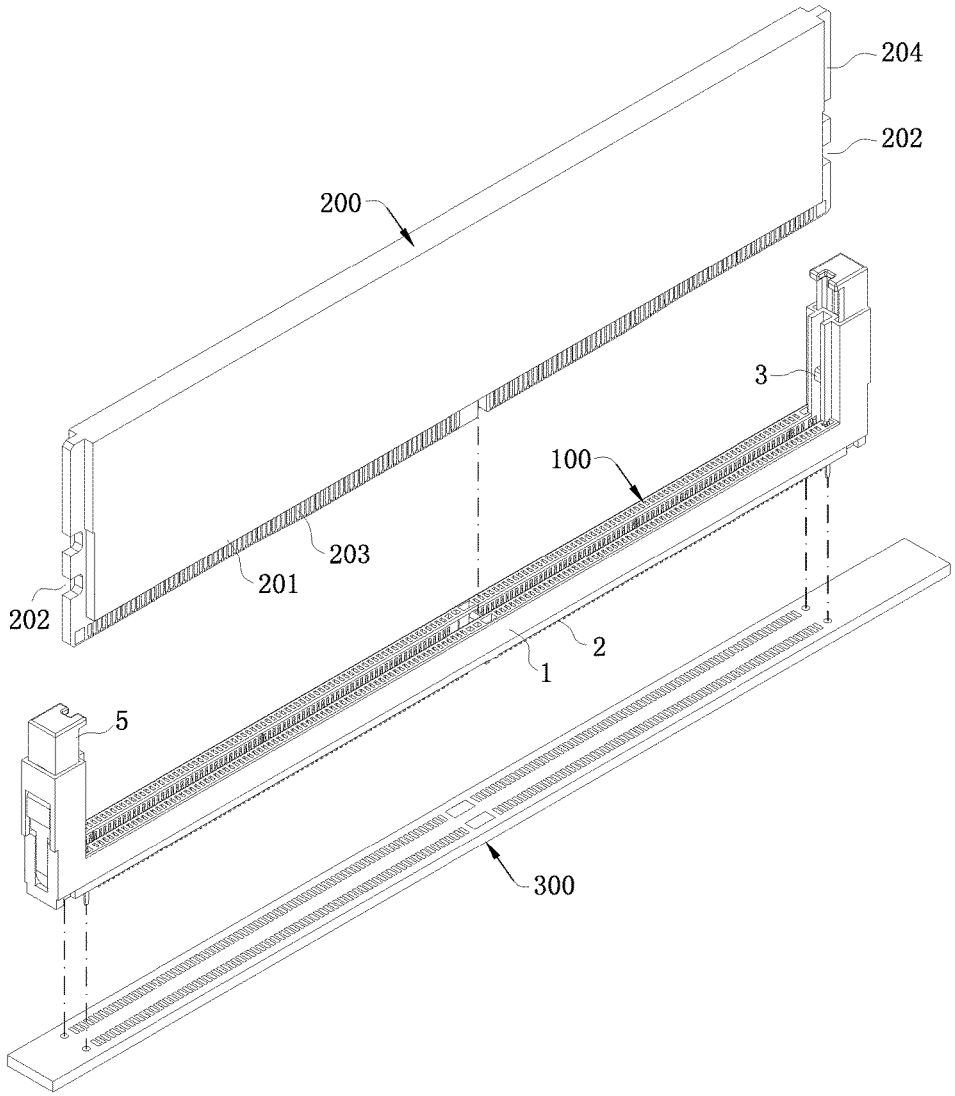
FIG. 1 is a schematic three-dimensional view of a card edge connector, a circuit board and an electronic card according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to a card edge connector.

Figure 2:
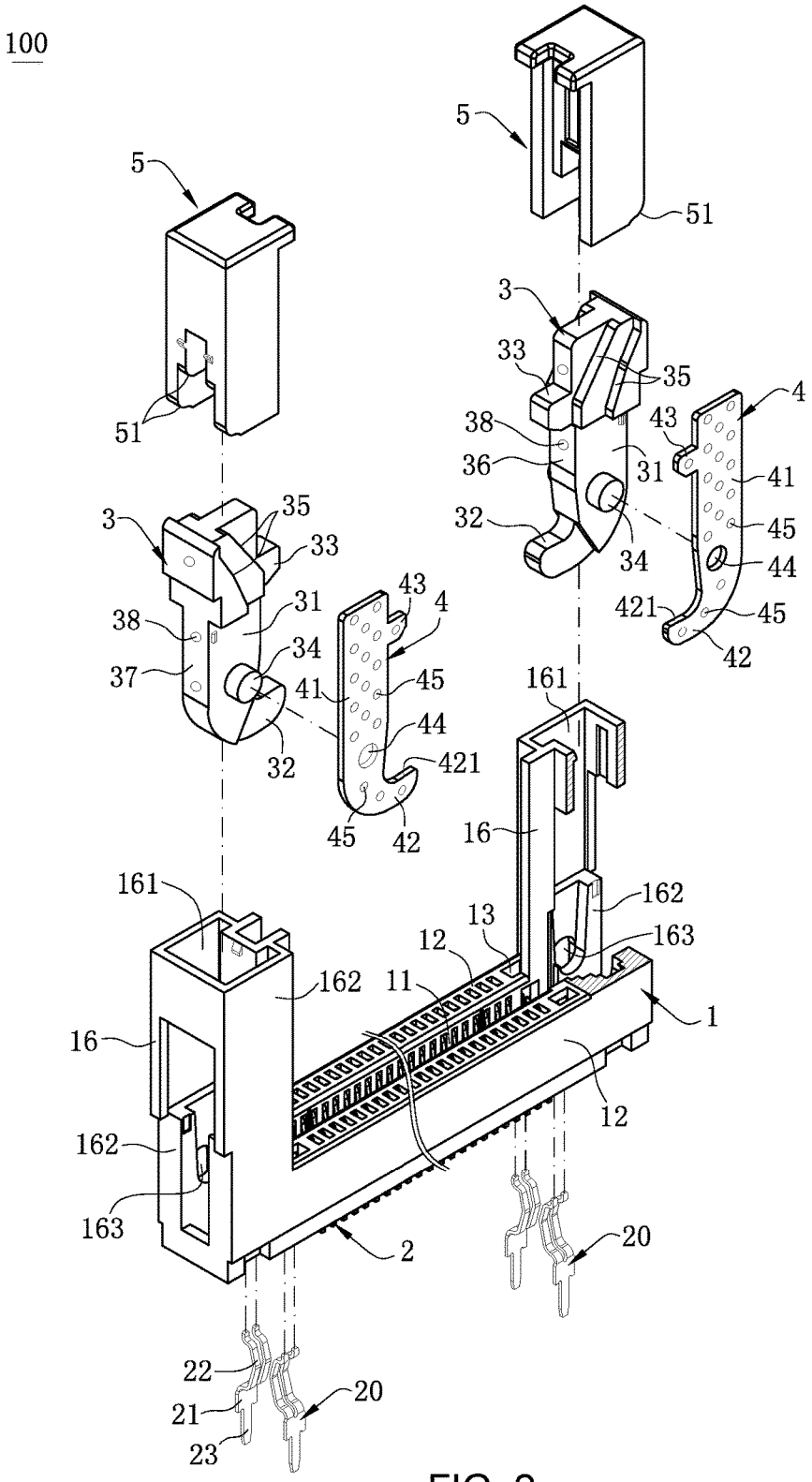
FIG. 2 is a schematic three-dimensional exploded view of a card edge connector according to one embodiment of the present invention.

FIGS. 1 and 2 show a card edge connector 100 according to a first embodiment of the present invention that is used for electrically connecting an electronic card 200 and a circuit board 300. The card edge connector 100 is downward installed at the circuit board 300. The card edge connector 100 includes an insulating body 1, multiple terminals 2, two plastic ear clips 3, two metal reinforcing members 4 and two pressing members 5. The electronic card 200 has an insertion end 201. Two surfaces of the insertion end 201 are respectively provided with multiple conductive sheets 203. The electronic card 200 has two side edges 204, and each side edge 204 is provided with at least one notch 202.

Figure 6:
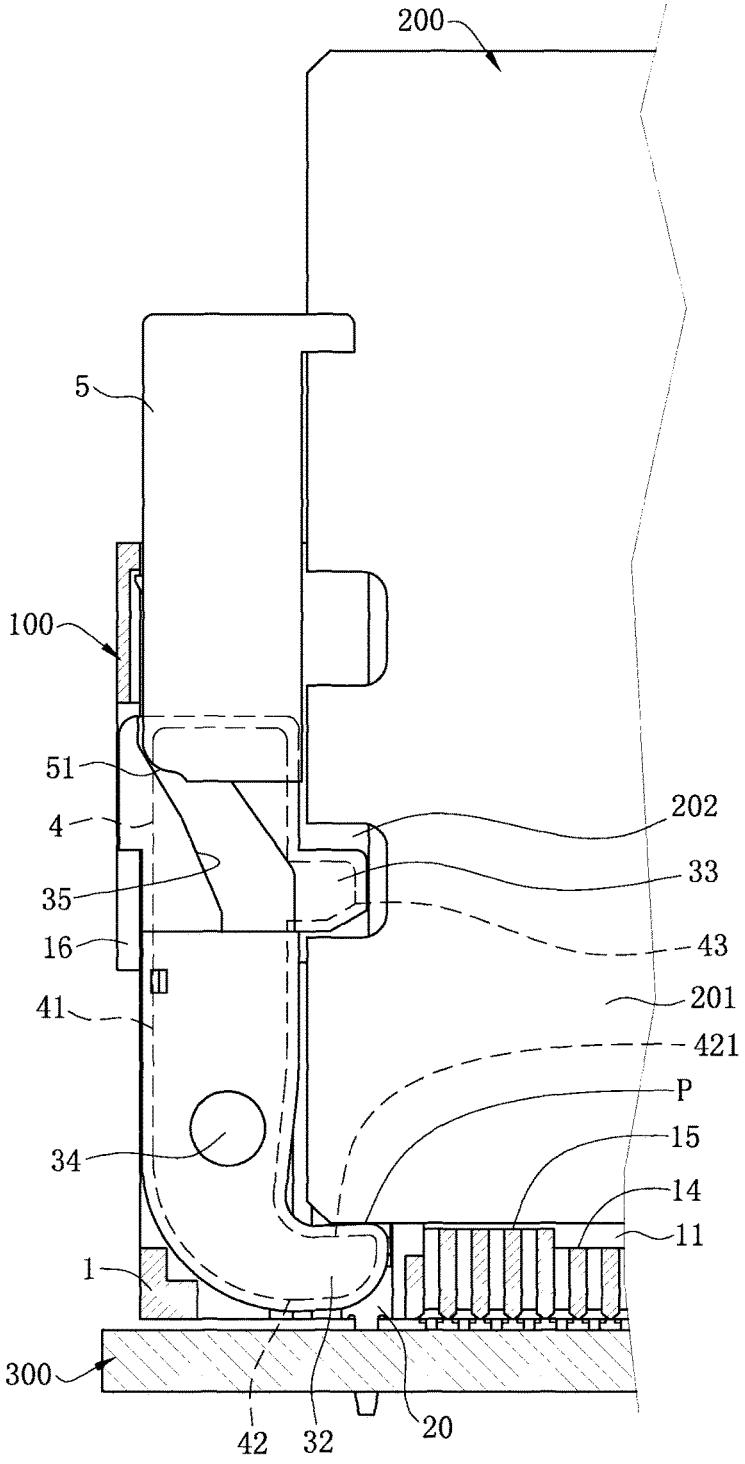
FIG. 6 is a sectional view of the plastic ear clip in a closing state in FIG. 5.

Referring to FIGS. 2 and 6, the insulating body 1 has a slot 11 extending along a lengthwise direction. The slot 11 is formed in a downward recessing manner from the upper surface of the insulating body 1, and the slot 11 is used for inserting the electronic card 200. The insulating body 1 has two side walls 12 disposed at two sides of the slot 11, each side wall 12 is provided with multiple terminal slots 13, and the terminal slots 13 are arranged in communication with the slot 11. The slot 11 has a bottom surface 14, and the insulating body 1 has a projecting portion 15 protruding upward from the bottom surface 14. The insulating body 1 has two mounting portions 16 disposed at two ends of the slot 11. Each mounting portion 16 has a receiving slot 161 and two lateral walls 162 disposed at two sides of the receiving slot 161. The lateral walls 162 are in a same plane with the side wall 12 at the corresponding side, and the bottom of the receiving slot 161 is communicated with the slot 11. The lateral walls 162 are respectively provided with a pivoting hole 163 at a lower position thereof.

Figure 3:
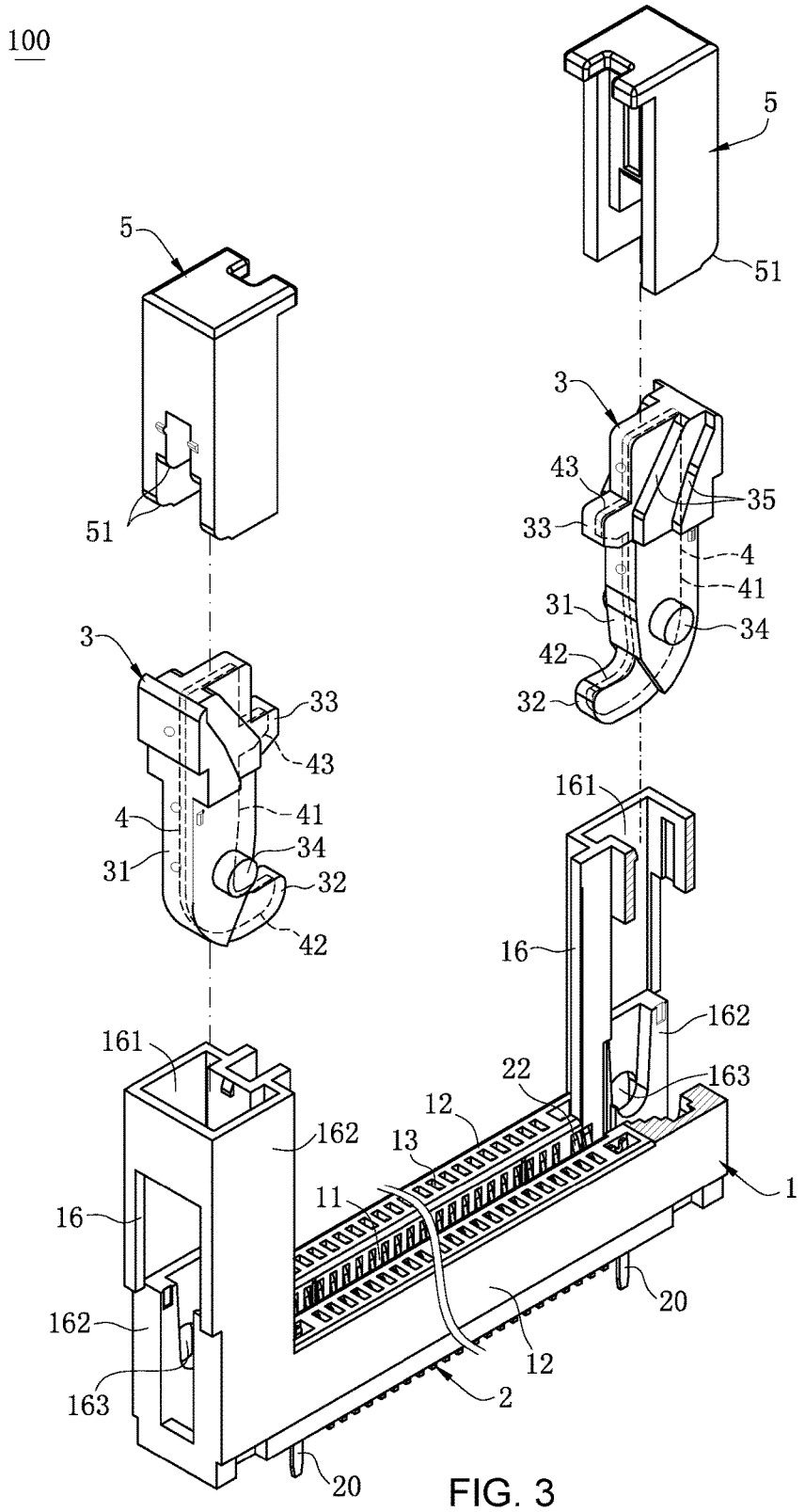
FIG. 3 is a schematic view of a metal reinforcing member after being embedded in a plastic ear clip in FIG. 2.

Referring to FIGS. 2 and 3, the multiple terminals 2 correspond to the multiple terminal slots 13 are disposed at two sides of the slot 11. The multiple terminals 2 include a pair of opposed first terminals 20 which are respectively disposed at one of two ends of the slot 11, and the first terminals 20 are power supply terminals. Each of the terminals 2 has a fixing portion 21 retained at the terminal slot 13, a contact portion 22 extending upward from the fixing portion 21 and protruding into the slot 11, and a soldering portion 23 extending downward from the fixing portion 21 and stretching out of the bottom of the insulating body 1.

Figure 7:
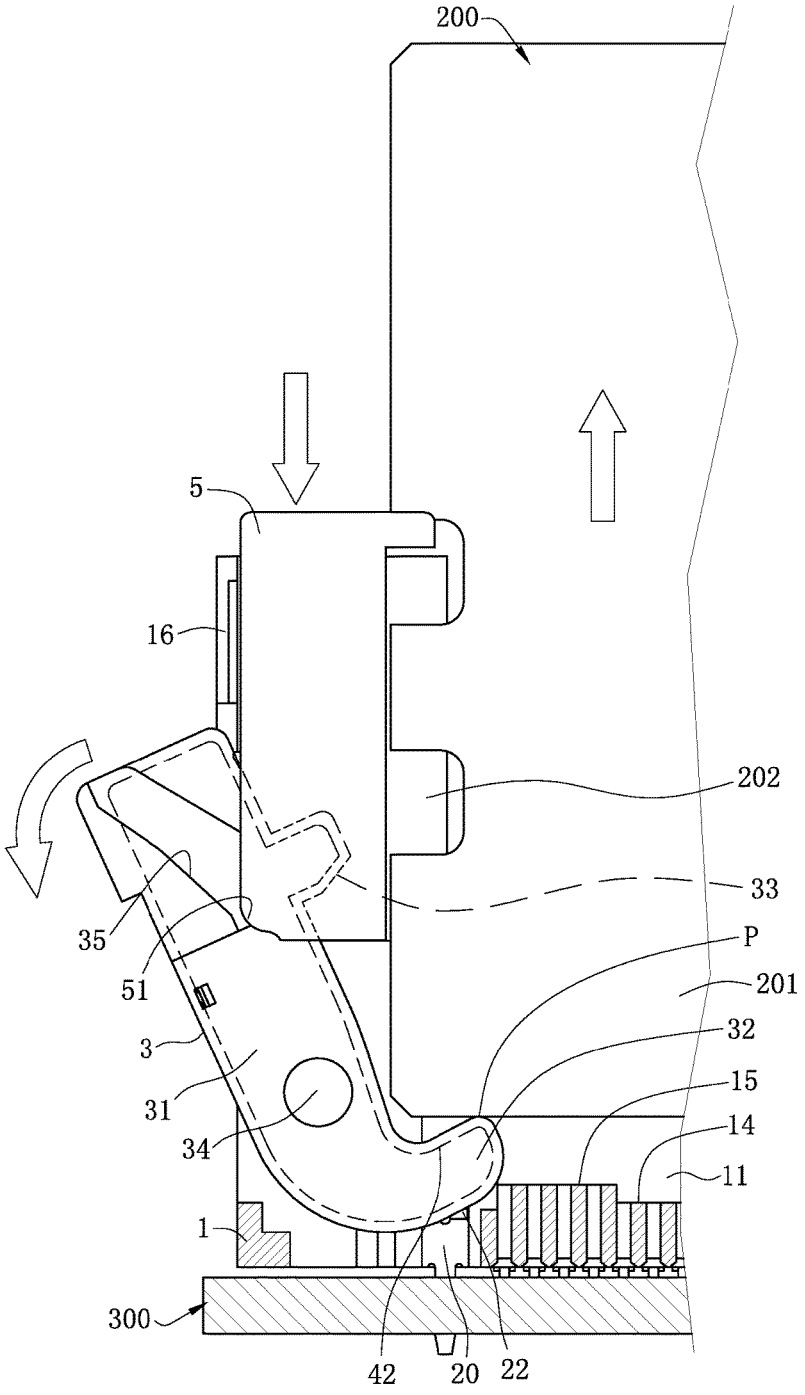
FIG. 7 is a sectional view of the plastic ear clip in an opening state in FIG. 5.

Referring to FIGS. 2, 6 and 7, the plastic ear clips 3 are received in the receiving slots 161. The plastic ear clips 3 respectively have a main body 31, a withdrawing portion 32 disposed at the lower end of the main body 31 and a buckle portion 33 extending from the main body 31. Both the buckle portion 33 and the withdrawing portion 32 extend toward the slot 11. Two sides of the main body 31 are respectively provided with a rotating shaft 34, and the rotating shafts 34 are cooperated with the pivoting holes 163, so that the plastic ear clips 3 can rotate relative to the insulating body 1 so as to be in an opening state and a closing state. The opening state is a state where the plastic ear clips 3 rotate outward relative to the slot 11 in the lengthwise direction to make the plastic ear clips 3 be in an inclining state, i.e. the withdrawing portion 32 upward pushes the insertion end 201 to make the plastic ear clips 3 completely release the electronic card 200. The closing state is a state where the plastic ear clips 3 are in a vertical state, i.e. the buckle portions 33 are buckled into the notches 202. Two sides of the main body 31 are also respectively provided with at least one crimping slope 35. The crimping slope 35 is disposed above the rotating shafts 34, and the crimping slope 35 forms an angle about 40° to 75° with the horizontal plane when the plastic ear clips 3 are in the vertical state. The main body 31 has an inner side surface 36 and an outer side surface 37 which are arranged correspondingly, and the main body 31 has multiple ejector pin holes 38 which are formed in a recessing manner from the inner side surface 36 and the outer side surface 37.

Figure 4:
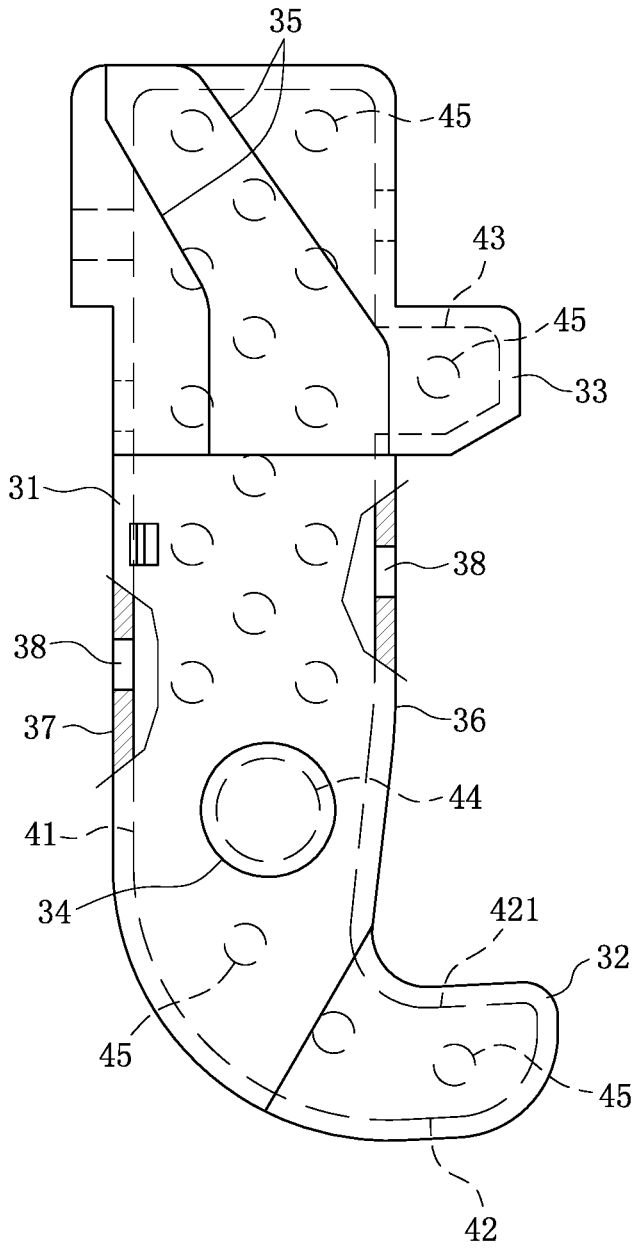
FIG. 4 is a front view of the metal reinforcing member and the plastic ear clip in FIG. 3.
Figure 5:
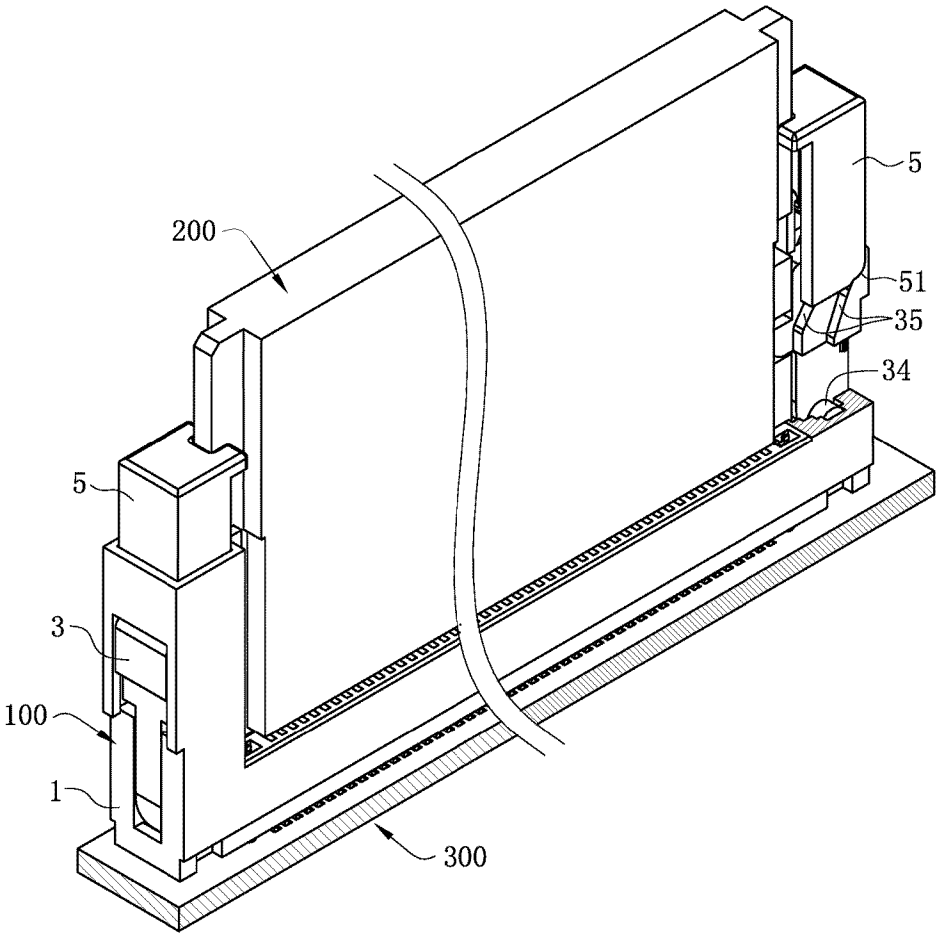
FIG. 5 is a schematic three-dimensional assembly view of FIG. 1.

Referring to FIGS. 2, 4 and 6, the metal reinforcing members 4 are embedded in the plastic ear clips 3. The metal reinforcing members 4 are formed by punching metal plates. A distance from a plate edge of each metal reinforcing member 4 to a corresponding outer surface of the plastic ear clip 3 is greater than or equal to 0.3 mm. In this way, the connection strength of the plastic ear clips 3 at the plate edges of the metal reinforcing members 4 can be ensured, and plastics at outer sides of two plate surfaces of the metal reinforcing members 4 are uneasy to separate due to an external force. In other embodiments, the upper surface 421 may be flush with the top surface of the withdrawing portion 32, and may also be slightly higher than the top surface of the withdrawing portion 32, so the abrasion resistance of the withdrawing portion 32 can be improved. The ejector pin holes 38 are arranged in connection with the plate edges of the metal reinforcing members 4, and in the molding process of the plastic ear clips 3, the metal reinforcing members 4 can be jacked, so that the metal reinforcing members 4 are firmly embedded in the plastic ear clips 3 and are uneasy to skew. The metal reinforcing members 4 respectively have a base portion 41, and a first protruding portion 42 and a second protruding portion 43 extending from the base portion 41. The base portion 41 extends in the main body 31, the first protruding portion 42 extends in the withdrawing portion 32, and the second protruding portion 43 extends in the buckle portion 33. The metal reinforcing members 4 respectively have a first through hole 44 and multiple second through holes 45 penetrating through two opposite plate surfaces. The plastic ear clips 3 are connected to two opposite sides of the metal reinforcing members 4 through the first through hole 44 and the second through holes 45, i.e. plastics formed in the first through hole 44 and the second through holes 45 when the plastic ear clips 3 are injection molded are integrally connected to the plastics at two sides of the metal reinforcing members 4 respectively. The first through hole 44 is disposed at the base portion 41, the first through hole 44 is arranged at a position corresponding to the rotating shaft 34, the size of the first through hole 44 is smaller than the size of the rotating shaft 34. In the present embodiment, the first through hole 44 is circular, the rotating shaft 34 is arranged coaxially with the first through hole 44, and of course, the first through hole 44 may also be in other shapes to meet the requirements. The metal reinforcing members 4 are provided with multiple second through holes 45 above and below the rotating shafts 34, i.e. the base portion 41 is also provided with multiple second through holes 45. The first protruding portion 42 and the second protruding portion 43 are respectively provided with at least one second through hole 45, so the plastic connection strength of the plastic ear clips 3 at two sides of the metal reinforcing members 4 can be better improved. The first protruding portion 42 has an upper surface 421. When the plastic ear clips 3 are in a closing state, the upper surface 421 is arranged to be higher than the bottom surface 14, and the upper surface 421 is arranged to be lower than the top surface of the projecting portion 15, so a majority of force with which the withdrawing portion 32 pushes the electronic card 200 may be shared by the first protruding portion 42.

Referring to FIGS. 2, 6 and 7, the pressing members 5 are also received in the receiving slots 161, and the pressing members 5 are disposed above the plastic ear clips 3. Two sides of the bottom of each pressing member 5 are respectively provided with an actuating portion 51. The actuating portion 51 urges the corresponding crimping slope 35. The actuating portion 51 can slide on the crimping slope 35 to make the plastic ear clips 3 rotate relative to the insulating body 1, and the pressing member 5 can only move in the up-down direction, so the pressing member 5 has a stroke in the up-down direction.

Referring to FIGS. 6 and 7, when the plastic ear clips 3 are in an opening state, the withdrawing portion 32 may obliquely protrude into the slot 11, and the pressing member 5 is disposed at the uppermost end of the stroke relative to the insulating body 1. When the electronic card 200 is inserted into the slot 11, the insertion end 201 may push the withdrawing portion 32 to make the plastic ear clips 3 gradually become relatively vertical from inclination until the buckle portion 33 is locked in the notch 202, and at the moment, the plastic ear clips 3 enter the closing state from the opening state. When a user applies a downward force to the pressing members 5, the actuating portion 51 slides on the crimping slope 35, so that the buckle portion 33 is separated from the notch 202, the plastic ear clips 3 rotate outward to be in the opening state from the closing state, where the withdrawing portion 32 may push the electronic card 200 to be separated from the slot 11, and at the moment, the pressing members 5 are disposed at the lowermost end of the stroke relative to the insulating body 1. When the plastic ear clips 3 completely release the electronic card 200, the withdrawing portions 32 and the first protruding portions 42 cross the contact portions 22 of the corresponding first terminals 20 in the lengthwise direction. Furthermore, in the process that the withdrawing portion 32 pushes the electronic card 200 to be separated from the slot 11, the withdrawing portion 32 urges the electronic card 200 to form an urging point P, and the urging point P is always disposed within a length range of the first protruding portion 42.

Referring to FIG. 2, in other embodiments, the card edge connector 100 may be only provided with one plastic ear clip 3 and one metal reinforcing member 4. The card edge connector 100 may also be provided with no pressing member 5, correspondingly the plastic ear clip 3 does not need to be provided with the crimping slope 35 cooperated with the pressing member 5, two ends of the insulating body 1 are respectively pivoted with one plastic ear clip 3, the metal reinforcing member 4 is also embedded in the plastic ear clip 3, the plastic ear clip 3 also has an operating portion (not shown) disposed at the upper end of the main body 31, and the user can press the operating portion to pull the plastic ear clip 3, so that the buckle portion 33 is separated from the notch 202.

In summary, the card edge connector according to certain embodiments of the present invention, among other things, has the following beneficial advantages:

1. The metal reinforcing members 4 are embedded in the plastic ear clips 3, and the metal reinforcing members 4 extend in the main body 31 and the withdrawing portion 32, so that the existence of the metal reinforcing members 4 improves the connection strength between the main body 31 and the withdrawing portion 32, i.e. the bearing capacity of the plastic ear clips 3 is improved. Therefore, when the withdrawing portion 32 pushes the electronic card 200 to be withdrawn from the slot 11, the withdrawing portion 32 is uneasy to break. Moreover, the metal reinforcing members 4 respectively have the first through hole 44, the first through hole 44 is arranged at the position corresponding to the rotating shafts 34, since the rotating shafts 34 are cooperated with the pivoting holes 163 to rotate, and the rotating shafts 34 are supporting points when the plastic ear clips 3 are subjected to a force, when the plastic ear clips 3 are injection molded, the plastics formed in the first through hole 44 are integrally connected to the plastics at two sides of the base portion 41, so that the connection strength between the rotating shafts 34 at two sides of the plastic ear clip 3 can be improved, and the rotating shaft 34 can be prevented from breaking from the main body 31 when being subjected to the force.

2. The size of the first through hole 44 is smaller than the size of the rotating shafts 34, so that the integral connection strength between the plastics molding the rotating shafts 34 and the plastics at the corresponding side of the base portion 41 is further improved, and the rotating shafts 34 are prevented from breaking from the main body 31 when being subjected to the force. The first through hole 44 is circular and is arranged coaxially with the rotating shaft 34, so that the integral connection strength between the plastics molding the rotating shafts 34 and the plastics at the corresponding side of the base portion 41 can be balanced.

3. The plastic ear clip 3 has the buckle portion 33 extending toward the slot 11 direction from the main body 31, and the metal reinforcing member 4 has the second protruding portion 43 extending into the buckle portion 33, so that the strength of the buckle portion 33 can be improved.

4. In the process that the withdrawing portion 32 pushes the electronic card 200 to be separated from the slot 11, the withdrawing portion 32 urges the electronic card 200 to form the urging point P, and the urging point P is always disposed within the length range of the first protruding portion 42 in the lengthwise direction, so as to ensure that the first protruding portion 42 can better share an acting force of the electronic card 200 on the withdrawing portion 32, and the breakage of the withdrawing portion 32 can be avoided.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A card edge connector, comprising:

an insulating body, having a slot extending along a lengthwise direction and used for an electronic card to be inserted therein;

a plurality of terminals, arranged at the insulating body, each of the terminals having a contact portion protruding into the slot to be electrically connected with the electronic card;

a plastic ear clip, having a main body and a withdrawing portion disposed at a lower end of the main body, wherein the plastic ear clip has two rotating shafts disposed at two opposite sides of the main body, the rotating shafts are pivoted to the insulating body, when the plastic ear clip rotates from a closing state to an opening state, the withdrawing portion pushes the electronic card to move outward from the slot; and a metal reinforcing member, embedded in the plastic ear clip, wherein the metal reinforcing member extends in the main body and the withdrawing portion, the metal reinforcing member has a first through hole and a plurality of second through hole, the first through hole aligns with the two rotating shafts, and at least one of the second through holes is disposed above the two rotating shafts and at least one of the second through holes is disposed below the two rotating shafts.

2. The card edge connector of claim 1, wherein a size of the first through hole is smaller than a size of each of the rotating shafts.

3. The card edge connector of claim 1, wherein the first through hole is circular and is arranged coaxially with the rotating shafts.

4. The card edge connector of claim 1, wherein the metal reinforcing member has a base portion and a first protruding portion extending from the base portion, the base portion extends in the main body, and the first protruding portion extends in the withdrawing portion.

5. The card edge connector of claim 4, wherein the terminals are arranged at two sides of the slot, the terminals comprise a pair of oppositely positioned first terminals disposed at one end of the slot, and when the plastic ear clip is in an opening state, the first protruding portion crosses the contact portions of the first terminals in the lengthwise direction.

6. The card edge connector of claim 5, wherein the first terminals are power supply terminals.

7. The card edge connector of claim 4, wherein the slot has a bottom surface, the first protruding portion has an upper surface, and when the plastic ear clip is in a closing state, the upper surface is arranged to be higher than the bottom surface.

8. The card edge connector of claim 7, wherein the insulating body has a projecting portion protruding upward from the bottom surface and used for upward supporting the bottom end of the electronic card, and when the plastic ear clip is in the closing state, the upper surface is arranged to be lower than the top surface of the projecting portion.

9. The card edge connector of claim 1, wherein the plastic ear clip has a buckle portion extending from the main portion to the slot direction, the buckle portion is used for locking the electronic card when in the closing state, and the metal reinforcing member has a second protruding portion extending into the buckle portion.

10. The card edge connector of claim 9, wherein the second protruding portion is provided with at least one second through hole.

11. The card edge connector of claim 1, wherein the main body has an inner side surface and an outer side surface which are arranged correspondingly in the lengthwise direction, the main body has multiple ejector pin holes which are formed in a recessing manner from the inner side surface and the outer side surface along the lengthwise direction, and the ejector pin holes are arranged in connection with the metal reinforcing member.

12. The card edge connector of claim 1, wherein the metal reinforcing member is in a flat shape, and a distance from a plate edge of the metal reinforcing member to a corresponding outer surface of the plastic ear clip is greater than or equal to 0.3 mm.

13. The card edge connector of claim 1, wherein the at least one of the second through holes disposed below the two rotating shafts is arranged in the withdrawing portion.

14. The card edge connector of claim 1, wherein the plastic ear clip has a buckle portion disposed at an upper end of the main body and used for locking the electronic card when in the closing state, the buckle portion and the withdrawing portion respectively extend from the main portion toward the slot in the lengthwise direction.

15. The card edge connector of claim 14, wherein in a process of the plastic ear clip changing from the closing state to the opening state, the withdrawing portion urges the electronic card to form an urging point, and the urging point is always disposed within a length range of the first protruding portion in the lengthwise direction.

16. The card edge connector of claim 1, further comprising a pressing member, wherein one end of the insulating body has a mounting portion, the plastic ear clip and the pressing member are installed at the mounting portion, the pressing member is disposed above the plastic ear clip, the plastic ear clip has at least one crimping slope, and the pressing member slides on the crimping slope to make the plastic ear clip rotate relative to the insulating body.

* * * * *